US006109667A

United States Patent [19]

Collins

[11] Patent Number: 6,109,667

[45] **Date of Patent: *Aug. 29, 2000**

[54] OVER-CENTER TOGGLE LATCH WITH INTEGRAL SWITCH

[76] Inventor: Matthew J. Collins, Clows Top, Kingsham, Nr. Tewksbury, Gloucestershire GL20 8HP, United Kingdom

[ * ] Notice: Under 35 U.S.C. 154(b), the term of this patent shall be extended for 326 days.

[21] Appl. No.: 08/541,519

[22] Filed: Oct. 10, 1995

[51] Int. Cl.[7] ..... E05C 19/02

[52] U.S. Cl. ..... 292/78; 292/153

[58] Field of Search ..... 292/153, 203, 292/341.17, 78, DIG. 49

[56] References Cited

U.S. PATENT DOCUMENTS

| | | | |
|---|---|---|---|
| 3,638,457 | 2/1972 | Filipak | 68/12 R |
| 3,841,677 | 10/1974 | Guth | 292/335 |
| 4,298,223 | 11/1981 | Raffelsiefer et al. | 292/216 |
| 4,351,288 | 9/1982 | Gasloli | 126/197 |
| 4,465,997 | 8/1984 | Hines | 340/542 |
| 4,613,176 | 9/1986 | Kelly | 292/201 |
| 4,655,489 | 4/1987 | Bisbing | 292/110 |
| 4,664,430 | 5/1987 | Bernard | 292/201 |
| 4,687,237 | 8/1987 | Bisbing | 292/78 |
| 4,745,250 | 5/1988 | Mayo | 219/10.55 |

FOREIGN PATENT DOCUMENTS

| | | | |
|---|---|---|---|
| 2 134 963 | 8/1984 | Germany | E05B 55/12 |

OTHER PUBLICATIONS

Southco, Inc. Latches Catalog, Snap–in Grabber Catch, pp. G2 & G3.

*Primary Examiner*—B. Dayoan
*Assistant Examiner*—Gary Estremsky

[57] ABSTRACT

An over-center toggle latch comprises a latch for securing two members together having a latch housing affixed to one of the members and a keeper having a projecting member affixed to the other of the members. Inside the housing is a toggle, mounted within the housing for pivotal movement between a first position and a second position. In the second position, the projecting member of the keeper is retained within the housing. In the first position, the projecting member of the keeper is released from the housing. A retaining means disposed within the housing is in pivotal contact with the housing and the toggle for retaining the toggle in either of the first or second positions. A protruding tab is disposed on the retaining means. A switch having a two-position push button actuator is located in the housing such that when the toggle is in a first position, the push button actuator is in a first position, and when the toggle is in the second position, the push button actuator is in a second position. When the toggle is in the first position, the push button is actuated to a first position by the protruding tab disposed on the retaining means. When the toggle member is in the second position, the push button is actuated to a second position by the protruding tab.

4 Claims, 4 Drawing Sheets

OVER-CENTER TOGGLE LATCH WITH INTEGRAL SWITCH

BACKGROUND OF THE INVENTION

This invention relates generally to latches and more specifically to latches of the over-center toggle type.

Over-center toggle latches are generally known in the art. These known latches do not contain an integral switch such that an electronic signal may be provided for indication when the door or other panel cover and cabinet to which this latch is mounted, is opened or closed. Typically, when such a latch is used, if one requires an electronic indication of whether the door or panel is opened or closed, a separate switch assembly is required, increasing cost, complexity, and space required in the manufactured item to which the latch is attached. Moreover, such a separate switch assembly requires separate critical alignment of the door or panel, in relation to the door jam or other fixed surface upon which the switch is mounted.

SUMMARY OF THE INVENTION

This invention relates to an over-center toggle latch of the type where a door can held closed at a predetermined, specific force. Additionally, the over-center toggle latch contains an integral electronic switch which provides an electronic signal that indicates whether a door or other panel to which this latch is attached is in an opened or closed position. Since the electronic switch is integral with the latch, advantageously, no critical alignment of a separate switch mounted on a door or panel, with respect to the fixed surface to which the door or panel is attached, is required.

The over-center toggle latch of the present invention comprises a latch for securing two members together, the latch having a latch housing affixed to one of the members and a keeper having a projecting member affixed to the other of the members. Inside the housing is a toggle, mounted within the housing for pivotal movement between a first position and a second position. In the second position, the projecting member of the keeper is retained within the housing. In the first position, the projecting member of the keeper is released from the housing. A retaining means disposed within the housing is in pivotal contact with the housing and the toggle for retaining the toggle in either of the first or second positions A protruding tab is disposed on the retaining means. A switch having a two-position push button actuator is located in the housing such that when the toggle is in a first position, the push button actuator is in a first position, and when the toggle is in the second position, the push button actuator is in a second position. When the toggle is in the first position, the push button is actuated to a first position by the protruding tab disposed on the retaining means. When the toggle member is in the second position, the push button is actuated to a second position by the protruding tab.

Accordingly, it is an object of the present invention to overcome the above-mentioned disadvantages by providing an over-center toggle latch having an integral switch that provides an electronic signal that indicates whether a door to which the latch assembly is mounted is opened or closed.

It is a further object of the present invention to provide an over-center toggle latch which includes an inexpensive, integral switch which is compact and simple in construction, thus reducing costs of manufacture, and simplifying assembly.

It is still another object of the present invention to provided an over-center toggle latch which includes an inexpensive integral switch, used to indicate whether a door to which the latch assembly is mounted is opened or closed that does not require critical alignment.

Other objects and advantages of the present invention will become apparent from the following description taken in conjunction with the accompanying drawings.

DESCRIPTION OF THE PREFERRED EMBODIMENT

Figure 1:
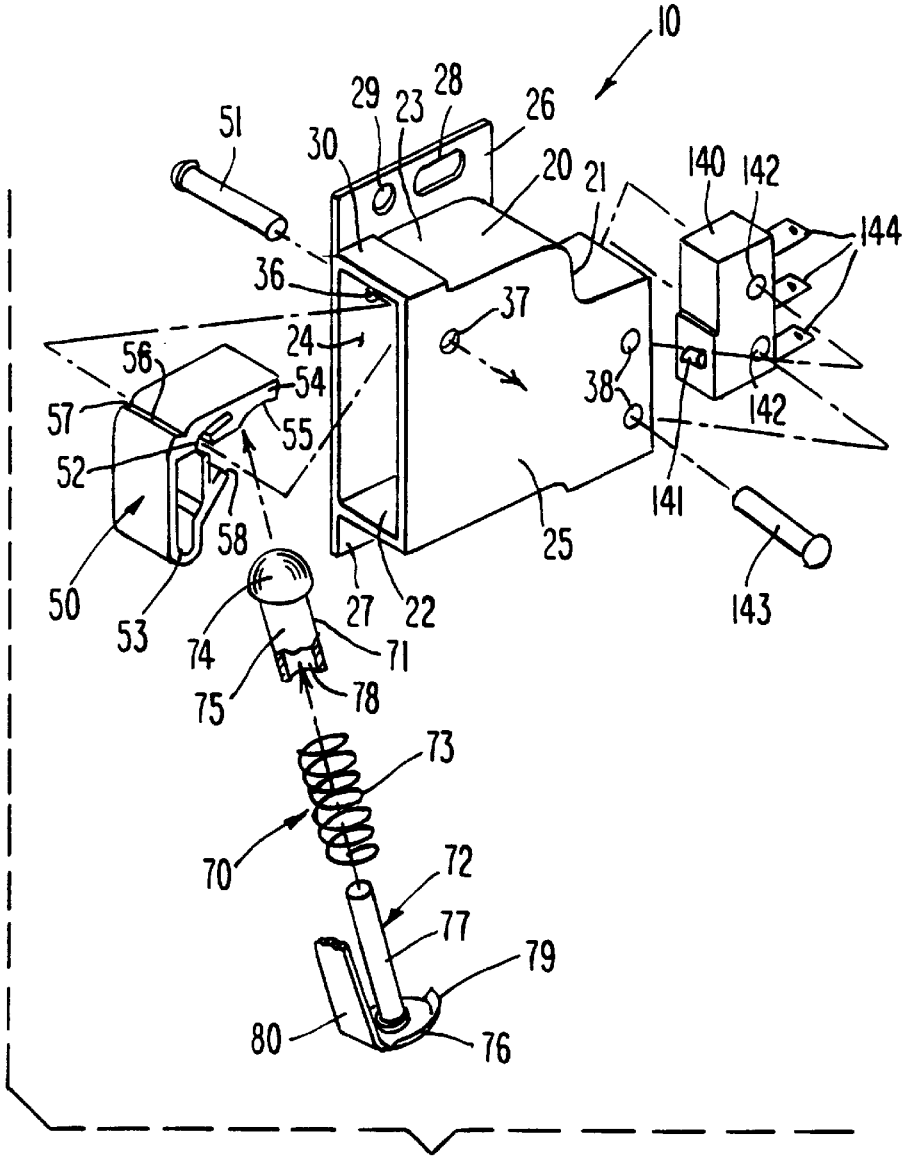
FIG. 1 is an exploded perspective view of one embodiment of the latch in accordance with the invention
Figure 2:
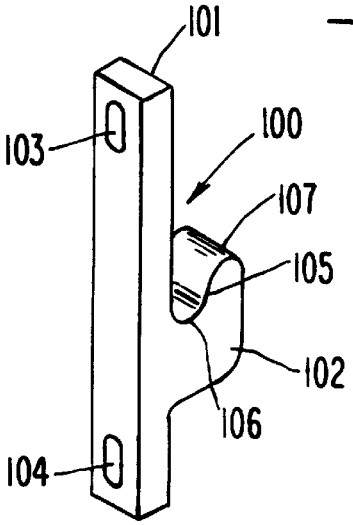
FIG. 2 is a perspective view of one embodiment of the latch keeper in accordance with the invention
Figure 3:
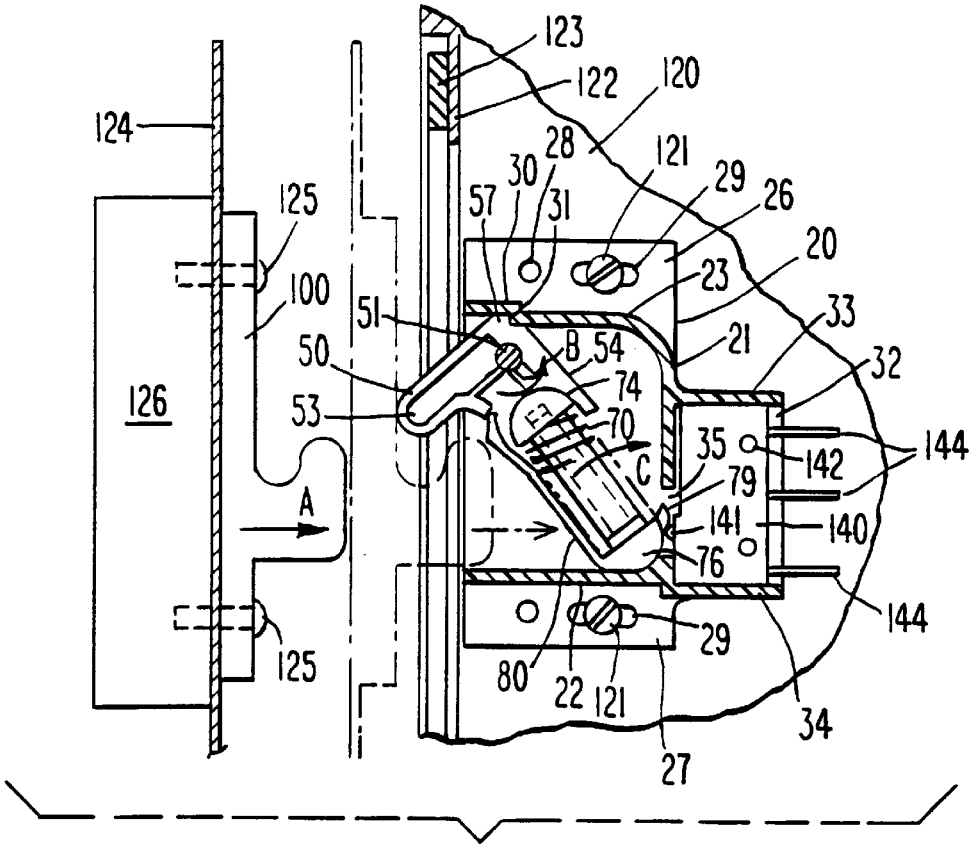
FIG. 3 is a cross-sectional view of one embodiment of the invention of FIGS. 1 and 2 as mounted to a door and cabinet structure with the door being in an opened position and the latch being in an unlatched condition.

Referring now in detail to the drawings, wherein like reference numerals indicate like elements throughout the several views, there is shown in FIG. 1 and 2 an over-center toggle latch with an integral switch 10 in accordance with one preferred embodiment of the present invention. The over-center toggle latch 10 of the present invention generally comprises a housing 20 having a back wall 21 and side walls 22, 23. The housing 20 is also provided with bottom wall 24 and top wall 25. Projecting from the side walls 22, 23 are mounting flanges 26, 27 which are provided with mounting openings, such as aperture 28 or slot 29 on flange 26, for facilitating the mounting of the housing 20 to a door-receiving structure. As seen in FIG. 3, side wall 23 is provided with a shelf portion 30 which forms shoulder 31 at an interior portion of side wall 23, the function of which is more fully described hereinafter On the back wall 21 of housing 20 is cavity 32, sized appropriately to accommodate a microswitch 140 which is more fully described hereinafter. Cavity 32 is bounded by back wall 21, side walls 33, 34 and top wall 25 (See FIG. 1). Back wall 21, which separates cavity 32 from the main cavity of the housing 20, contains back wall aperture 35 connecting cavity 32 and the main cavity in the housing.

Toggle member 50 is pivotally mounted within housing 20 by pivot pin 51 which extends through aperture 52 in toggle member 50 and apertures 36, 37 in bottom and top walls 24, 25 of housing 20 (See FIG. 1). The pivotal movement of toggle member 50 about pin 51 is best seen in FIGS. 3 and 4.

As seen in the Figures, toggle member 50 is an irregular shaped member having a latch projection 53 and a leg 54 extending at generally right angles to one another from the aperture 52. Leg 54 is provided with a concave portion 55 on its interior surface, the function of which will be described more fully hereinafter Toggle member 50 is notched on its external surface as at 56 to form ear projection 57 which cooperates with shoulder 31 of wall 23 and functions as a stop in the pivotal movement of the toggle member 50 when the toggle member is in the open, unlatched position (See FIG. 3).

Figure 4:
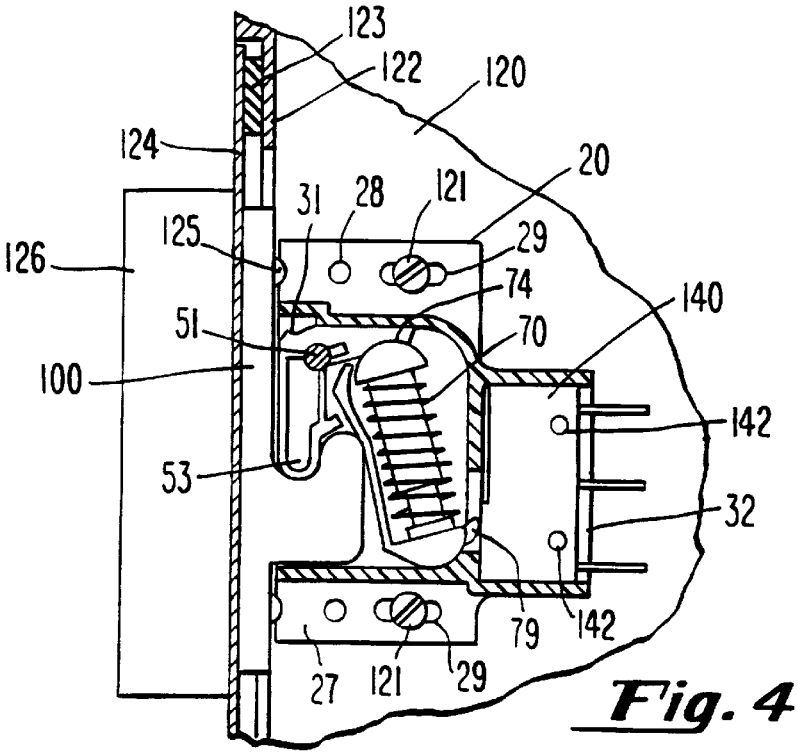
FIG. 4 is a cross-sectional view of the mounted invention of FIGS. 1 and 2, similar to that of FIG. 3, wherein the door is in the closed position and the latch is in a latched condition.

Retaining means 70 is also provided within housing 20 to retain the toggle member 50 in the opened or closed positions, as illustrated in FIGS. 3 and 4, respectively. The retaining means 70 comprises a pair of guide members 71, 72 and a spring 73. Guide member 71 comprises a head portion 74 and a sleeve portion 75, which head portion 74 has a convex surface adapted to be received in concave portion 55 of leg 54 of toggle member 50.

Figure 6A:
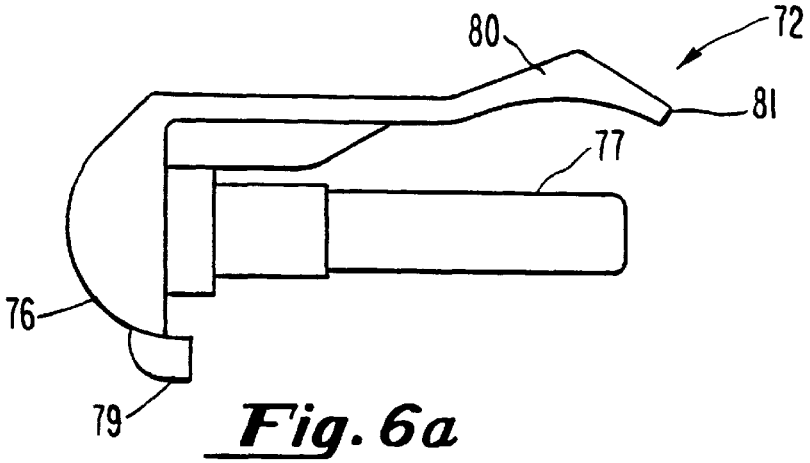
FIG. 6*a* is a front view of a guide member as used in the latch of FIG. 1.

As can be seen in FIGS. 1 through 4 and in detail in FIG. 6*a*, guide member 72 comprises a head portion 76 and a rod portion 77, which head portion 76 is also provided with a convex surface adapted to be received in the corner formed by side wall 22 and back wall 21 of housing 20. Sleeve portion 75 of guide member 71 is provided with bore 78 sized to closely receive rod portion 77 of guide member 72 for sliding telescopic engagement therewith. Spring 73 is sized so as to be received between head portions 74, 76 of guide members 76, 72 when rod portion 77 is positioned within bore 78 of sleeve portion 75, and urges head portions 74, 76 apart when positioned within housing 20. Also integral to guide member 72 are switch tab 79 and safety tang 80 (See FIG. 6). Switch tab 79 is described in detail hereinafter. Safety tang 80 is provided to ensure that retaining means remains in position in housing 20 when latch 10 is opened and closed. Free end 81 of safety tang 80 engages with protrusion 58 of toggle member 50 whereby retaining means 70 is kept from dislodging from its proper position within housing 20.

Referring now to the embodiment of FIGS. 1 and 2, illustrated therein is keeper 100 having a base portion 101 and a dog projection 102 extending therefrom. Base portion 101 is provided with mounting apertures, such as slots 103, 104 to facilitate the mounting of keeper 100 on a door. As seen in FIG. 2, dog projection 102 is generally "L"-shaped and extends outwardly and then upwardly from base portion 101 of keeper 100. The shape of dog projection 102 is such as to form an "S"-shaped inner surface 105 having a convex portion 107 and a concave portion 106, which concave portion 106 is adapted to receive latch projection 53 of toggle member 50 when toggle member 50 is in the closed position as in FIG. 4, so that latch projection 53 overlaps convex portion 107 of dog projection 102 when the toggle member 50 is in the closed position.

As indicated above, disposed in housing 20 is microswitch 140 in cavity 32. Cavity side walls 33, 34, as well as housing bottom wall 24 and top wall 25 (See FIG. 1) and housing back wall 21 are dimensioned such that microswitch 140 may be slid into place into the cavity 32 formed by those walls. Microswitch 140 is held in position in cavity 32 by fastening means such as rivet 143, screws (not shown), plastic snap-in fastener (not shown) or other fastening device known in the art, through apertures 38 in housing 20 and apertures 142 in microswitch 140. If necessary, the switch may easily be replaced if damaged or inoperable. The back wall 21 has an aperture 35 from cavity 32 through to the main cavity of the housing 20 such that the push button actuator 141 of microswitch 140 is accessible to switch tab 79 of retaining means 70. Operation of the microswitch 140 by the switch tab 79 on the retaining means 70 will be described in detail hereinafter.

The operation of the over-center toggle latch of the present invention will now be described more fully with reference to FIGS. 3 and 4. As illustrated in the Figures, the latch housing 20 is mounted on a door receiving structure, such as cabinet 120, by screws 121 or other conventional means, through slots 29 in flanges 26, 27. Cabinet 121 has a door-receiving surface 122 which may be provided with a gasket 123, if desired. Keeper 100 is shown attached to door 124 such as by screws 125 extending through the mounting slots 103, 104 (See FIG. 1) of base portion 101 and connected to door handle 126.

From the open, unlatched position illustrated in FIG. 3, door 124 is moved toward cabinet 120, in the direction of arrow A until keeper base 101 comes in contact with latch projection 53 of the toggle member 50 which, in the opened position, is extending from the housing 20, as shown. That is, keeper 100 reaches the position illustrated in FIG. 3 in broken lines As can be seen in FIG. 3, in the broken line position, dog projection 102 of keeper 100 is received within housing 20. Further movement of door 124 toward cabinet 120, in the direction of arrow A, causes toggle member 50 to pivot in the direction of arrow B, which in turn, causes retaining means 70 to pivot in the direction of arrow C, whereby the toggle member 50 is snapped into the closed, latched position illustrated in FIG. 4.

As can be seen in FIG. 4, when the toggle member has snapped into the closed position, latch projection 53 nests within concave portion 106 and overlaps convex portion 107 of dog projection 102 whereby door 124 is held tightly against gasket 123 on surface 122 of cabinet 120.

Figure 5:
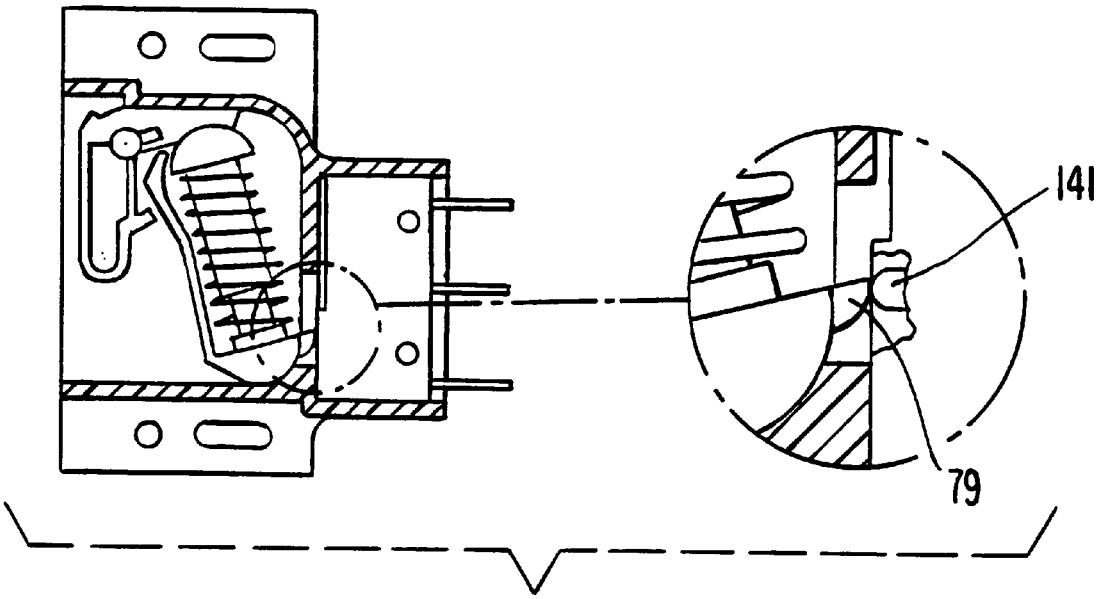
FIG. 5 is a cross-sectional view of the latch of FIG. 1, in a closed position, also showing a detail front view indicating a switch (in section) having its push button actuator pushed to a depressed position.

Also illustrated in the Figures is the function of retaining means 70. As seen in FIG. 3, when the toggle member is in the open, unlatched position, convex surfaces of head portions 74, 76 of guide members 71, 72 respectively, are urged apart by spring 73 to exert pressure on concave surface 55 of leg 54 and the corner of housing 20 formed by back wall 21 and side wall 22 which, in turn, serves to retain toggle member 50 in the opened position (see also FIG. 1). When in the closed, latched position, as illustrated in FIG. 4, toggle member 50 is retained therein, again by the outwardly force generated by spring 73 on head portions 74, 76 of guide members 71, 72 respectively (see also FIG. 1). Microswitch 140 is of the type in which its actuator button 141 normally remains in the "out" position by an internal spring. The actuator button 141 will remain out unless a force is applied. When the toggle member 50 is moved to the opened position, switch tab 79 of retaining means 70, which protrudes radially from the head of lower guide member 76, is rotated up and away from the push button actuator 141 of microswitch 140. Thus, push button actuator 141 is in an undepressed condition when the toggle member 50 is in the opened position, as shown in FIG. 3. However, when toggle member 50 is moved to the closed position, switch tab 79 of retaining means 70 is rotated down, through back wall aperture 35 of housing 20 such that push button actuator 141 of microswitch 140 is depressed, as shown in FIG. 4 and in detail in FIG. 5. Microswitch 140 is a standard switch having terminals 140 to mate with standard connectors (not shown), as known in the art to provide electrical connection to the switch. Housing 20 may be modified however, to house any standard push button switch of suitable size having a short stroke.

Figure 6B:
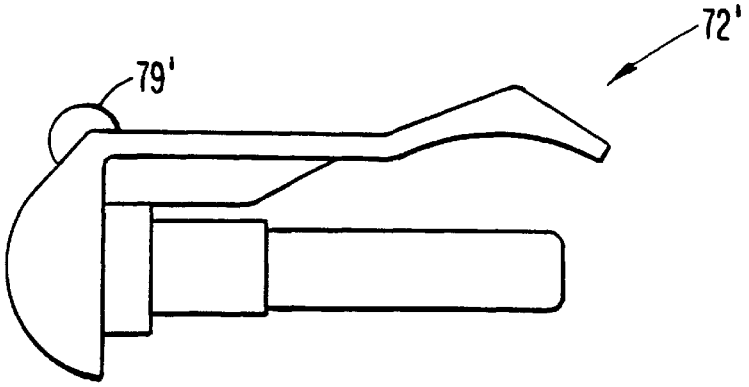
FIG. 6*b* is a front view of a guide member as used in an alternate embodiment of the latch.
Figure 8:
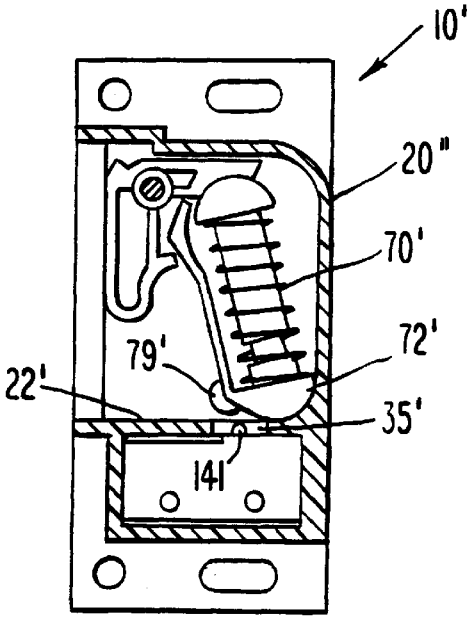
FIG. 8 is a cross-sectional view of an another alternate embodiment of the latch having an alternate housing, with the switch located in the alternate position of FIG. 7, and the latch in the closed position.
Figure 7:
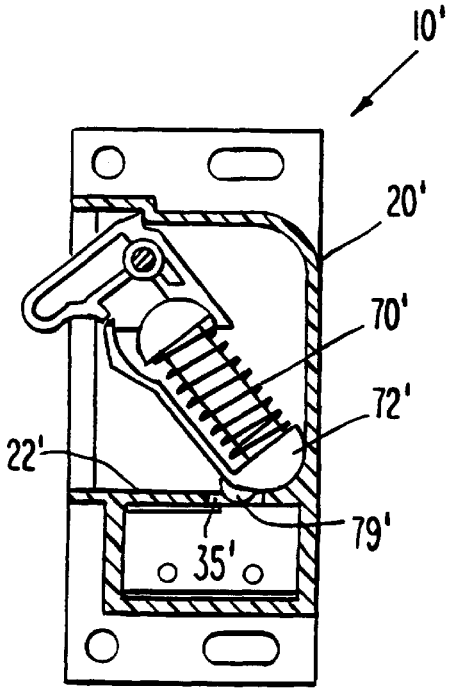
FIG. 7 is a cross-sectional view of the alternate embodiment of the latch with the switch located in an alternate position, with the latch in the opened position and using the guide member of FIG. 6*b*.

In an alternate embodiment 10' as shown in FIGS. 6*b*, 7 and 8, switch tab 79' may be located on the opposite side of the lower guide member 72' of retaining means 70'. Here microswitch 140 is located in the lower part of the housing 20' (or 20" showing an alternate housing) to give the latch 10 a tall, rather than wide profile. In this alternate embodiment, aperture 35' is provided in side wall 22' rather than the back wall of the housing. Retaining means 70 follows the same arc as that in the first embodiment, however, here, the push-button actuator 141 of microswitch 140 is in an undepressed condition when latch 10 is in the closed position (See FIG. 8), and push-button actuator 141 is in a depressed condition when latch 10 is in the opened position (See FIG. 7).

As can be seen from the above-described function of the latch, the force by which the door is held against the surface of the receiving structure is a function of the compressive strength of the spring. Thus, the force by which the door is held closed can be readily altered, if desired, by substitution of springs having different compressive properties The foregoing disclosure is illustrative of preferred embodiments only and is not to be viewed as a limitation of the invention, and it is to be understood that various modifications or equivalents may suggest themselves, all of which are within the spirit and scope of the invention, the boundaries of which are intended to be defined by the appended claims.

I claim:

1. An over-center toggle latch for securing two members together, said latch comprising:

(a) a latch housing adapted for being affixed to one of the members;

(b) a keeper means having a projecting member, said keeper means affixed to the other of the members;

(c) a toggle means, pivotally mounted within said housing for pivotal movement between a first position and a second position, whereby in said second position, said projecting member of said keeper is retained within said housing and whereby in said first position, said projecting member of said keeper is released from said housing;

(d) retaining means disposed within said housing and in pivotal contact with each of said housing and said toggle means for retaining said toggle means in either of said first and second positions;

(e) a protruding tab, disposed on said retaining means, (f) a switch having a two-position push button actuator disposed in said housing such that when said toggle means is in said first position, said push button actuator is in a first position , and when said toggle means is in said second position, said push button actuator is in said second position;

(g) wherein said keeper means comprises means for pivoting said toggle means from said first position to said second position upon the closing of said latch;

(h) wherein said keeper means comprises means for pivoting said toggle means from said second position to said first position upon the opening of said latch; and (i) wherein when said toggle means is in said first position, said push button is actuated to said first position by said protruding tab disposed on said retaining means, and wherein when said toggle member is in said second position, said push button is actuated to said second position by said protruding tab.

2. The over-center toggle latch of claim 1, wherein said two-position push button switch is in a depressed condition when said latch is in said closed position and in an undepressed condition when said latch is in said opened position.

3. An over-center toggle latch for securing two members together, said latch comprising:

(a) a latch housing adapted for being affixed to one of the members;

(b) a keeper having a base portion adapted for being affixed to the other of the members, having a dog projection connected to said base portion and extending therefrom, said dog projection adapted for being received within said housing and retained therein when the latch is in a closed position and released when the latch is in an opened position;

(c) a toggle member, pivotally mounted within said housing for pivotal movement between a first position, to receive said dog projection, and a second position in overlying disposition to said dog projection and in sandwich orientation to said base portion and said dog projection, whereby said dog projection is retained within said housing;

(d) retaining means disposed within said housing and in pivotal contact with each of said housing and said toggle member for retaining said toggle member in said first and second positions, said retaining means comprising a first guide member and a second guide member in telescopic relation to said first guide member, said first guide member having a body portion and a head portion, said head portion having a generally convex outer surface in pivotal sliding engagement with a generally concave surface on said toggle member, said second guide member having a body portion and a head portion, said head portion having of said second guide member having a generally convex outer surface in pivotal sliding contact with an inner wall of said housing, and a coil spring disposed about said body portions of said first guide member and contacting said head portions of said first and second guide members, said coil spring comprising means for urging said guide members apart and for urging said head portions into contact with said toggle member and said housing wall;

(e) a protruding tab, disposed on said head of said first guide member, extending out perpendicularly from said head;

(f) a switch having a two-position push button actuator, disposed in said housing;

(g) wherein said base portion of said keeper comprises means for pivoting said toggle member from said first position to said second position upon the closing of said latch;

(h) wherein when said toggle member is in said first position said push button is actuated to a first position by said protruding tab, and wherein when said toggle member is in said second position, said push button is actuated to a second position by said protruding knob;

(i) wherein said dog projection of said keeper comprises means for pivoting said toggle member from said second position to said first position upon the opening of said latch; and (j) wherein said dog projection of said keeper is disposed between said toggle member and said retaining means when said latch is in a closed position.

4. The over-center toggle latch of claim 3, wherein said two-position push button switch is in a depressed condition when said latch is in said closed position and in an undepressed condition when said latch is in said opened position.

* * * * *